US007677911B2

(12) United States Patent
Asada et al.

(10) Patent No.: US 7,677,911 B2
(45) Date of Patent: Mar. 16, 2010

(54) CONNECTOR CONNECTION STRUCTURE, CONNECTOR CONNECTION METHOD AND VEHICLE

(75) Inventors: Jun Asada, Toyota (JP); Eiji Aoki, Makinohara (JP); Tomokazu Yamane, Makinohara (JP); Takeaki Kaneko, Makinohara (JP); Hajime Kato, Makinohara (JP)

(73) Assignees: Toyota Jidosha Kabushiki Kaisha, Toyota-shi (JP); Yazaki Corporation, Minato-ku (JP)

( * ) Notice: Subject to any disclaimer, the term of this patent is extended or adjusted under 35 U.S.C. 154(b) by 22 days.

(21) Appl. No.: 12/188,618

(22) Filed: Aug. 8, 2008

(65) Prior Publication Data

US 2009/0042452 A1 Feb. 12, 2009

(30) Foreign Application Priority Data

Aug. 10, 2007 (JP) ..... 2007-209377

(51) Int. Cl.
*H01R 13/52* (2006.01)

(52) U.S. Cl. ..... 439/271

(58) Field of Classification Search ..... 439/271, 439/272–278, 685, 395; 174/35, 72, 100, 174/151

See application file for complete search history.

(56) References Cited

U.S. PATENT DOCUMENTS 4,458,102 A * 7/1984 White ..... 174/43
5,801,465 A * 9/1998 Yamada ..... 310/71
6,454,612 B1 * 9/2002 Wang ..... 439/694
6,583,352 B2 * 6/2003 Fukushima et al. ..... 174/373
6,692,278 B2 * 2/2004 Abadia et al. ..... 439/287
6,767,240 B2 * 7/2004 Pavlovic et al. ..... 439/395
7,041,907 B2 * 5/2006 Miyazaki ..... 174/72 A
7,071,416 B2 * 7/2006 Ricco et al. ..... 174/100
7,201,596 B1 * 4/2007 Bukovnik et al. ..... 439/276
7,264,494 B2 * 9/2007 Kennedy et al. ..... 439/274
7,335,042 B2 * 2/2008 Chirumbolo ..... 439/282
2004/0121639 A1 * 6/2004 Yaworski et al. ..... 439/276

FOREIGN PATENT DOCUMENTS

JP 59-036174 U 3/1984
JP 05-109440 A 4/1993
JP 2002-281654 A 9/2002
JP 2002-324616 A 11/2002

* cited by examiner

*Primary Examiner*—Alexander Gilman
(74) *Attorney, Agent, or Firm*—Kenyon & Kenyon LLP

(57) ABSTRACT

A connector connection structure includes: a case having a side surface and a top surface, respectively extending in directions crossing each other at a first angle, and an opening; a connector terminal portion inserted into the case from the opening; a shield plate closing the opening; a bolt fastening the case and the shield plate; and a terminal block arranged in the case and connected to the connector terminal portion. The shield plate has a first portion extending along the side surface and closing the opening, a second portion extending along the top surface, and a bent portion positioned between the first portion and the second portion and bent at a second angle being smaller than the first angle. The bolt fastens the case and the second portion of the shield plate.

6 Claims, 5 Drawing Sheets

CONNECTOR CONNECTION STRUCTURE, CONNECTOR CONNECTION METHOD AND VEHICLE

This nonprovisional application is based on Japanese Patent Application No. 2007-209377 filed on Aug. 10, 2007 with the Japan Patent Office, the entire contents of which are hereby incorporated by reference.

BACKGROUND OF THE INVENTION

1. Field of the Invention

The present invention relates to a connector connection structure, a connector connection method and a vehicle, and particularly, to a connector connection structure and a connector connection method in which a connector terminal portion is inserted into an opening provided at a wall surface of a casing, and to a vehicle including such a structure.

2. Description of the Background Art

A connector connection structure in which a connector terminal portion is inserted into an opening provided at a wall surface of a casing is disclosed in, for example, Japanese Patent Laying-Open No. 2002-281654 (Patent Document 1) and Japanese Patent Laying-Open No. 2002-324616 (Patent Document 2).

When an opening is provided at a wall surface of a casing, in some cases, it is necessary to close the opening to ensure shielding feature in order to suppress noise attributed to a vibration source arranged in the casing.

In Patent Documents 1 and 2, a closing member closing an opening provided at a wall surface of a casing is provided. The closing member is fixed to the casing by a bolt. The bolt is inserted from the direction that is identical to the insert direction f a connector terminal. Accordingly, when other devices are arranged at the position opposite to the wall surface of the casing and in proximity to the casing, in some cases it may be difficult to tighten the bolt. An attempt to reserve a great space at the position opposite to the wall surface where the opening is provided for performing the tightening work of the bolt reduces the device storage performance.

SUMMARY OF THE INVENTION

An object of the present invention is to provide a connector connection structure and a connector connection method capable of closing an opening of a case while improving the device storage performance, and a vehicle including such a structure.

A connector connection structure according to the present invention includes: a case having first and second surfaces extending in directions crossing each other at a first angle and an opening formed at the first surface; a connector terminal portion inserted into the case from the opening; a terminal block arranged in the case and connected to the connector terminal portion; a closing portion having a first portion extending along the first surface and closing the opening, a second portion extending along the second surface, and a bent portion positioned between the first portion and the second portion and bent at a second angle being smaller than the first angle, and a fastening member inserted into the case from above the second surface and fastening the case and the second portion of the closing portion.

With the above-described configuration, in accordance with the second portion of the closing portion being fastened to the case by the fastening member, the first portion of the closing portion can be deformed so as to conform to the first surface positioned around the opening, thereby causing the first portion to tightly adhere to the first surface so that the opening is closed by the first portion. Here, since the connector terminal portion and the fastening member are inserted into the case from directions different from each other, even when the space is tight at the portion opposite to the connector attaching portion, the space for performing insertion and tightening of the fastening member can easily be ensured. Accordingly, a connector connection structure capable of closing the opening of the case while improving the performance of storing a device can be provided.

In the connector connection structure, preferably, the second angle is an acute angle.

In the connector connection structure, preferably, the connector terminal portion and the terminal block are fixed to each other by an additional fastening member, and the additional fastening member is inserted into the connector terminal portion and the terminal block from an identical direction as the fastening member.

In the connector connection structure, preferably, a control apparatus controlling a rotating electric machine for driving a vehicle is arranged in the case.

A connector connection method according to the present invention includes the steps of: storing a terminal block in a case having first and second surfaces extending in directions crossing each other at a first angle and an opening formed at the first surface; inserting a connector terminal portion into the case from the opening, and arranging, on the case, a closing portion having a first portion positioned on the first surface, a second portion positioned on the second surface, and a bent portion positioned between the first portion and the second portion and bent at a second angle being smaller than the first angle; and fastening the case and the second portion of the closing portion by a fastening member inserted from above the second surface while deforming the first portion of the closing portion so as to conform to the first surface positioned around the opening, thereby closing the opening by the first portion.

With the above-described method, in accordance with the second portion of the closing portion being fastened to the case by the fastening member, the first portion of the closing portion can be deformed so as to conform to the first surface positioned around the opening, thereby causing the first portion to tightly adhere to the first surface so that the opening is closed by the first portion. Here, since the connector terminal portion and the fastening member are inserted into the case from directions different from each other, even when the space is tight at the portion opposite to the connector attaching portion, the space for performing insertion and tightening of the fastening member can easily be ensured. Accordingly, a connector connection method capable of closing the opening of the case while improving the performance of storing a device can be provided.

A vehicle according to the present invention includes the above-described connector connection structure.

According to the present invention, the performance of storing a device to which a connector is attached can be improved.

The foregoing and other objects, features, aspects and advantages of the present invention will become more apparent from the following detailed description of the present invention when taken in conjunction with the accompanying drawings.

DESCRIPTION OF THE PREFERRED EMBODIMENTS

Figure 1:
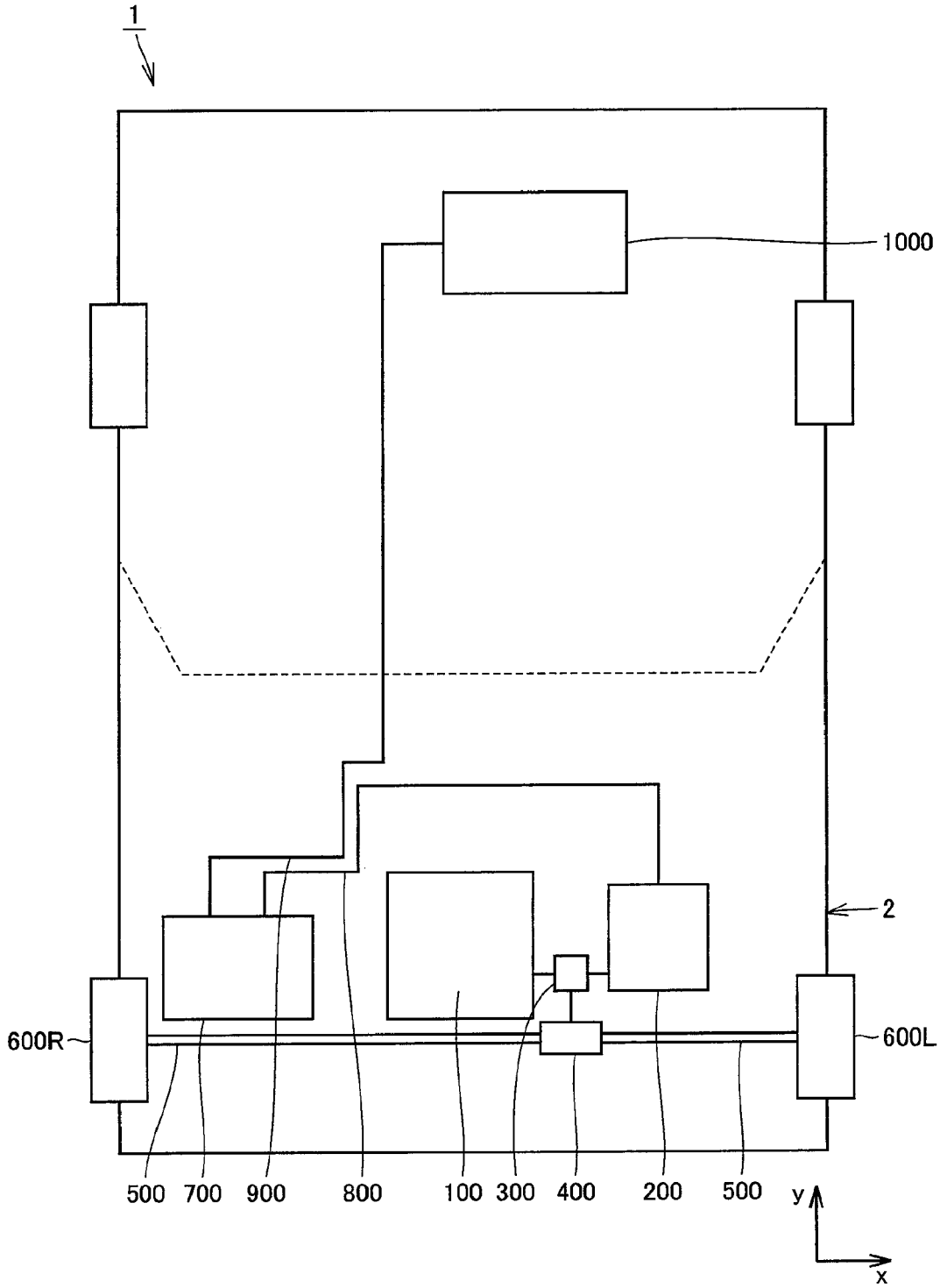
FIG. 1 is a schematic diagram showing a configuration of a hybrid vehicle to which a connector connection structure according to one embodiment of the present invention is applied.

In the following, an embodiment of the present invention will be described. The same or corresponding parts are denoted by the same reference character and description thereof may not be repeated.

In the embodiment described in the following, reference to the number or quantity does not necessarily limit the scope of the present invention to the exact number or quantity, unless otherwise specified. Also, in the following embodiment, constituents are not necessarily essential for the present invention, unless otherwise specified. When there are several embodiments, combination of the configurations of the embodiments is originally envisaged, unless otherwise specified.

FIG. 1 is a schematic diagram showing a configuration of a hybrid vehicle having an electric device connector structure according to one embodiment of the present invention.

Referring to FIG. 1, a hybrid vehicle 1 is configured to include an engine 100, a motor-generator 200, a power split device 300, a differential mechanism 400, a driveshaft 500, driving wheels 600L, 600R being the front wheels, a PCU (Power Control Unit) 700, cables 800, 900, and a battery 1000.

As shown in FIG. 1, engine 100, motor-generator 200, power split device 300, and PCU 700 are arranged inside engine room 2. Motor-generator 200 and PCU 700 are connected by cable 800. PCU 700 and battery 1000 are connected by cable 900. A power output apparatus formed by engine 100 and motor-generator 200 is coupled to differential mechanism 400 via power split device 300 and a reduction gear mechanism. Differential mechanism 400 is coupled to driving wheels 600L, 600R via driveshaft 500.

Motor-generator 200 is a three-phase AC (alternating current) synchronous motor-generator that generates drive force by AC power received from PCU 700. Motor-generator 200 is also used as a generator upon deceleration or the like of hybrid vehicle 1. By the generation function (regeneration), motor-generator 200 generates AC power which is output to PCU 700. Power split device 300 is configured to include a planetary gear, for example.

PCU 700 converts a DC (direct current) voltage received from battery 1000 into an AC voltage and exerts control to drive motor-generator 200. PCU 700 also converts an AC voltage generated by motor-generator 200 into a DC voltage and charges battery 1000.

Figure 2:
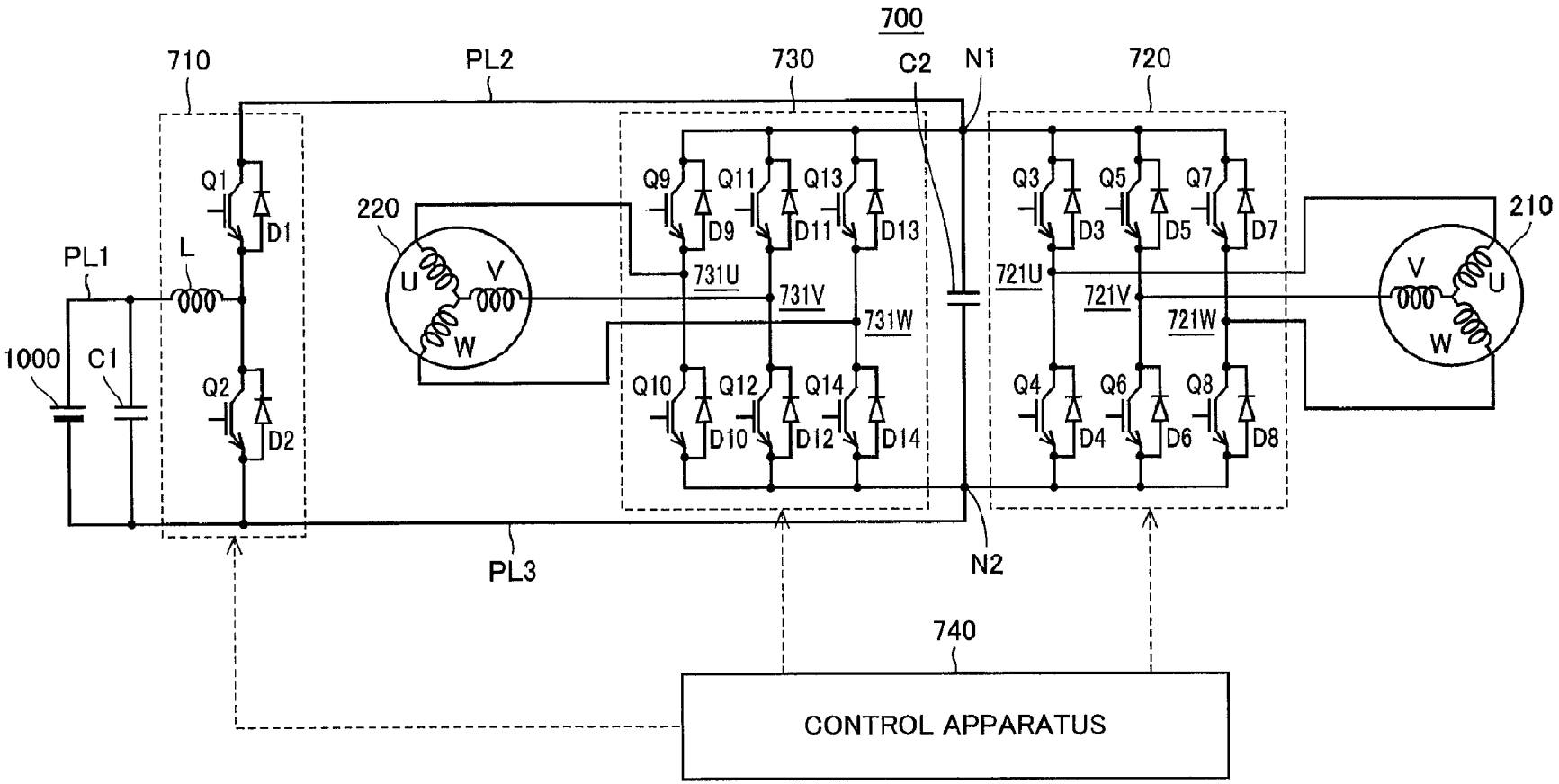
FIG. 2 is a circuit diagram showing a configuration of a substantial part of a PCU shown in FIG. 1.

FIG. 2 is a circuit diagram showing a configuration of a substantial part of PCU 700. Referring to FIG. 2, PCU 700 is a "control apparatus" controlling motor-generator 200 being a "rotating electric machine for driving a vehicle", and PCU 700 is configured to include a converter 710, inverters 720, 730, a control apparatus 740, a filter capacitor C1, and a smoothing capacitor C2. Converter 710 is connected between battery 1000 and inverters 720, 730. Inverters 720, 730 are respectively connected to motor-generator(s) 200 (210, 220).

Converter 710 includes power transistors Q1, Q2, diodes D1, D2, and a reactor L. Power transistors Q1, Q2 are connected in series and receive at the base a control signal from control apparatus 740. Diodes D1, D2 are connected between collector and emitter of power transistors Q1, Q2, respectively, so as to pass currents from emitter side to collector side of power transistors Q1, Q2. Reactor L has one end connected to power supply line PL1 that is connected to the positive electrode of battery 1000, and has the other end connected to a connection point of power transistors Q1 and Q2.

Converter 710 uses reactor L to boost a DC voltage received from battery 1000, and supplies the boosted boost voltage to power supply line PL2. Also, converter 710 steps down a DC voltage received from inverters 720, 730 and charges battery 1000.

Inverters 720, 730 respectively include U-phase arms 721U, 731U, V-phase arms 721V, 731V and W-phase arms 721W, 731W. U-phase arm 721U, V-phase arm 721V and W-phase arm 721W are connected in parallel between a node N1 and a node N2. Similarly, U-phase arm 731U, V-phase arm 731V and W-phase arm 731W are connected in parallel between node N1 and node N2.

U-phase arm 721U includes two power transistors Q3, Q4 connected in series. Similarly, U-phase arm 731U, V-phase arms 721V, 731V and W-phase arms 721W, 731W respectively include two power transistors Q5-Q14 connected in series. Diodes D3-D14 are connected between collector and emitter of power transistors Q3-Q14, respectively, so as to pass currents from emitter side to collector side.

The phase arms of inverters 720, 730 have their intermediate points connected to respective phase ends of respective phase coils of motor-generators 210, 220. In each of motor-generators 210, 220, the three U-, V-, and W-phase coils have their one ends connected together to a neutral point.

Filter capacitor C1 is connected between power supply lines PL1 and PL3, and smoothes the voltage level of power supply line PL1. Smoothing capacitor C2 is connected between power supply lines PL2 and PL3 and smoothes the voltage level of power supply line PL2.

Based on a drive signal from control apparatus 740, inverters 720, 730 convert a DC voltage received from smoothing capacitor C2 into an AC voltage and drive motor-generators 210, 220.

Control apparatus 740 calculates each phase coil voltage of motor-generators 210, 220 based on a motor torque command value from an external ECU, each phase current value of motor-generators 210, 220, and input voltages of inverters 720, 730. Based on the calculation result, control apparatus 740 generates a PWM (Pulse Width Modulation) signal turning on/off power transistors Q3-Q14 and outputs the same to inverters 720, 730.

Control apparatus 740 calculates a duty ratio of power transistors Q1, Q2 for optimizing the input voltages of inverters 720, 730, based on the above-mentioned motor torque command value and a motor rotation speed. Based on the calculation result, control apparatus 740 generates a PWM signal turning on/off power transistors Q1, Q2 and outputs the same to converter 710.

Furthermore, control apparatus 740 exerts control over the switching operation of power transistors Q1-Q14 in converter 710 and inverters 720, 730, so as to convert AC power generated by motor-generators 210, 220 into DC power and charge battery 1000.

Figure 3:
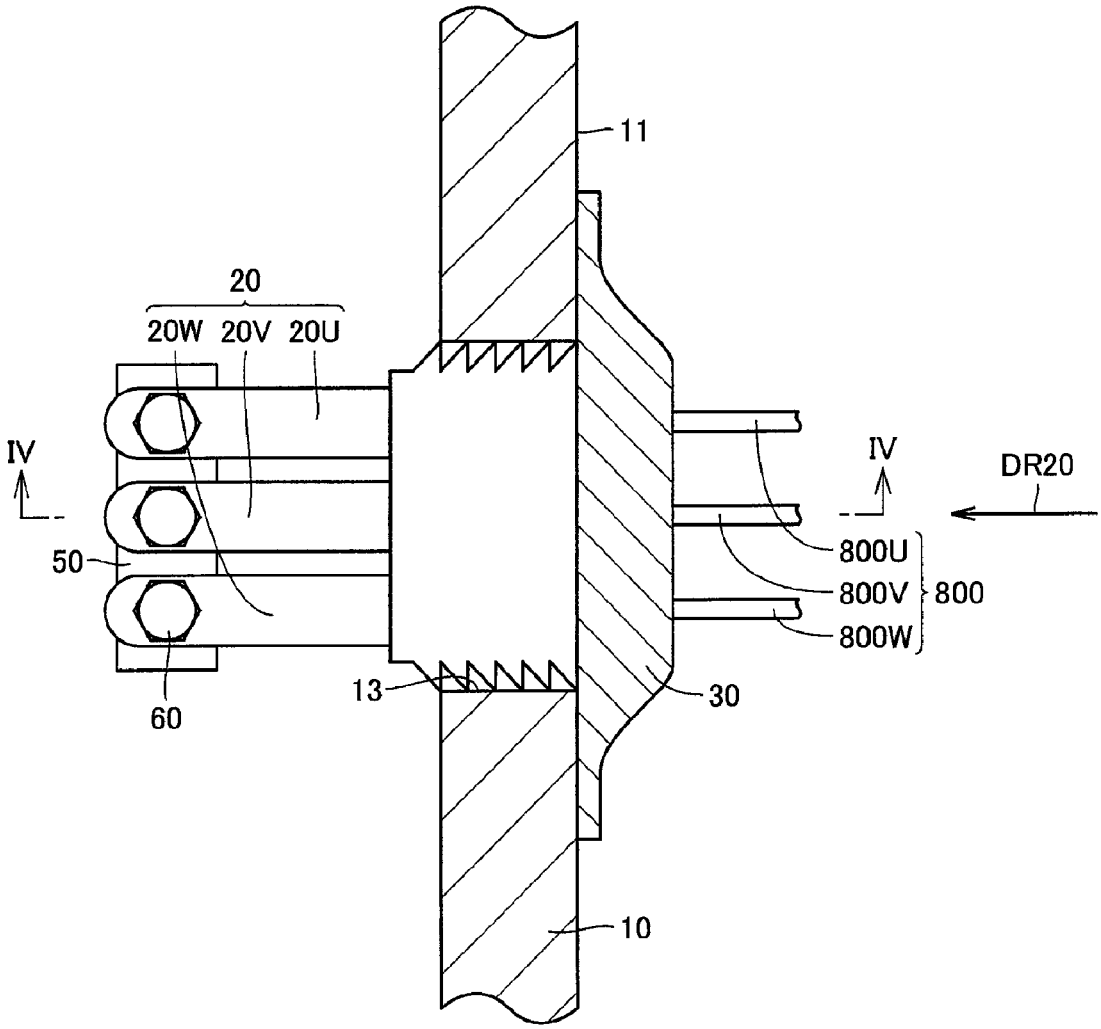
FIG. 3 is a cross-sectional view of a top surface of a connector terminal insert portion to a casing, in the connector connection structure according to one embodiment of the present invention.
Figure 4:
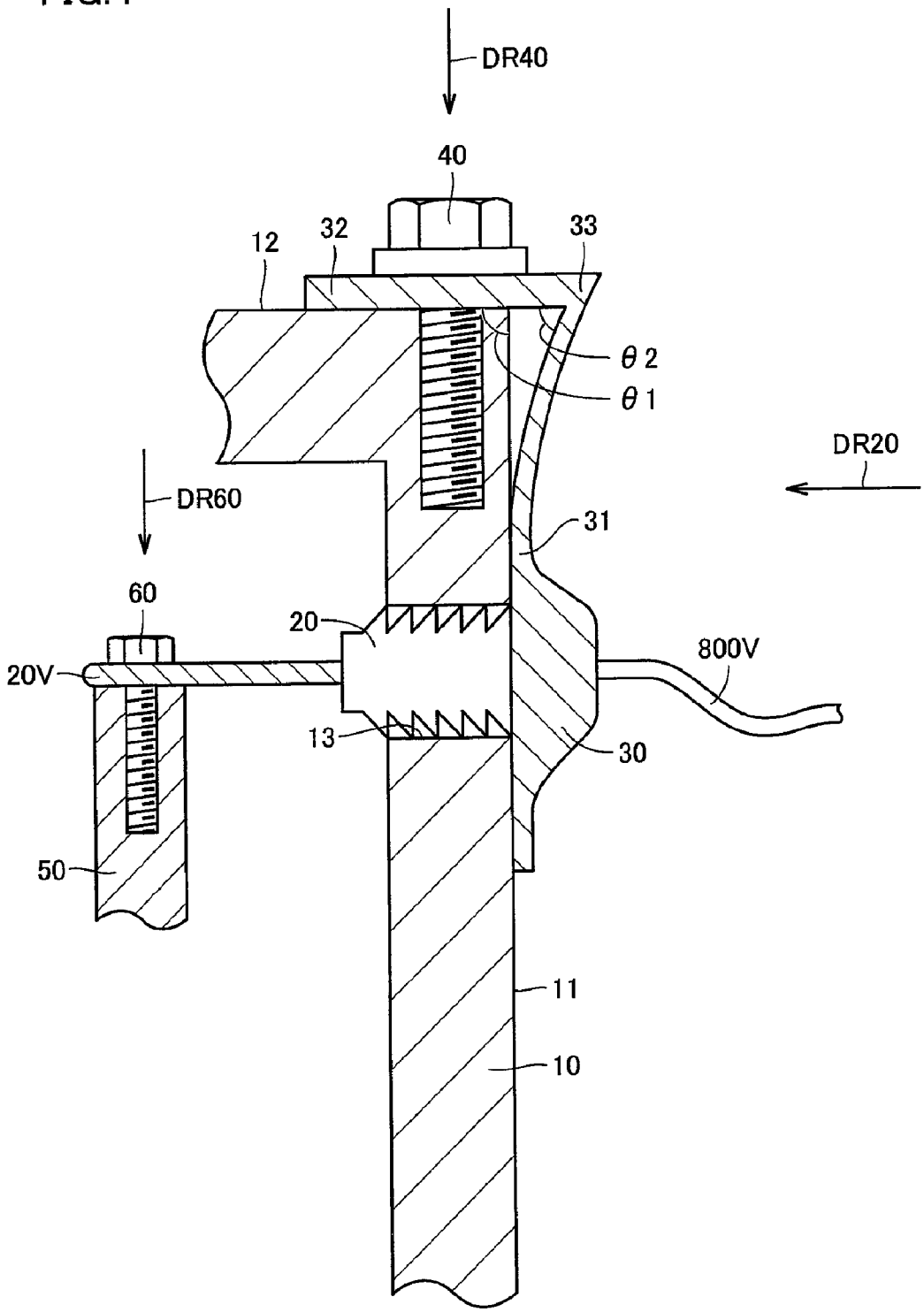
FIG. 4 is a cross-sectional view along IV-IV in FIG. 3.

Next, referring to FIGS. 3 and 4, a connector connection structure according to the present embodiment will be described. FIG. 3 is a cross-sectional view of a top surface of a connector terminal insert portion to a casing. FIG. 4 is a cross-sectional view along IV-IV in FIG. 3. The connector connection structure according to the present embodiment is applied to, for example, a connection portion to PCU 700 of cable 800 connecting PCU 700 and motor-generator 200, as shown in FIGS. 3 and 4.

Referring to FIGS. 3 and 4, the connector structure according to the present embodiment is configured to include a case 10, a connector terminal portion 20, a shield plate 30, bolts 40, 60, and a terminal block 50.

Electric components constituting converter 710, inverters 720, 730, and control apparatus 740 included in PCU 700 are arranged in case 10 that is formed by aluminum, for example. Case 10 is configured to include a side surface 11, a top surface 12, and an opening 13 provided on side surface 11. Side surface 11 and top surface 12 extend in directions crossing each other at an angle θ1. In a typical example, angle θ1 is 90°. Connector terminal portion 20 has a U-phase terminal 20U, a V-phase terminal 20V, and a W-phase terminal 20W U-phase terminal 20U, V-phase terminal 20V, and W-phase terminal 20W are respectively connected to a U-phase cable 800U, a V-phase cable 800V, a W-phase cable 800W. U-phase terminal 20U, V-phase terminal 20V, and W-phase terminal 20W are inserted into case 10 along arrow DR20 direction from opening 13, and fastened to terminal block 50 inside case 10 by bolt 60 inserted along arrow DR60 direction. Thus, cable 800 and PCU 700 are electrically connected.

To connector terminal portion 20, shield plate 30 is attached. Shield plate 30 has a first portion 31 positioned on side surface 11, a second portion 32 positioned on top surface 12, and a bent portion 33 positioned between first portion 31 and second portion 32. Specifically, shield plate 30 has a substantially-L shape that is bent at bent portion 33 at an angle θ2. Here, angle θ2 is smaller than angle θ1 (i.e., θ1>θ2). In FIG. 4, the difference between angle θ1 and angle θ2 is exaggerated with respect to the typical example. In the typical example, θ1 is about 90°, while θ2 is about 89°. The values of angle θ1 and angle θ2 can be changed as appropriate.

The lower portion of first portion 31 of shield plate 30 is closely attached to side surface 11 of case 10. Thus, opening 13 is closed. A portion positioned above the closely attaching portion of first portion 31 curves (elastically deforms) in a direction away from side surface 11. Second portion 32 of shield plate 30 extends along top surface 12 of case 10. In this manner, the close attachment feature of the lower portion of first portion 31 to side surface 11 is ensured by the resilient force of shield plate 30, and shielding feature of the connector connection portion is ensured. Each element constituting PCU 700 arranged in case 10 may possibly become a vibration source and a cause of noise, and therefore it is important to ensure shielding feature of the connector connection portion.

Figure 5:
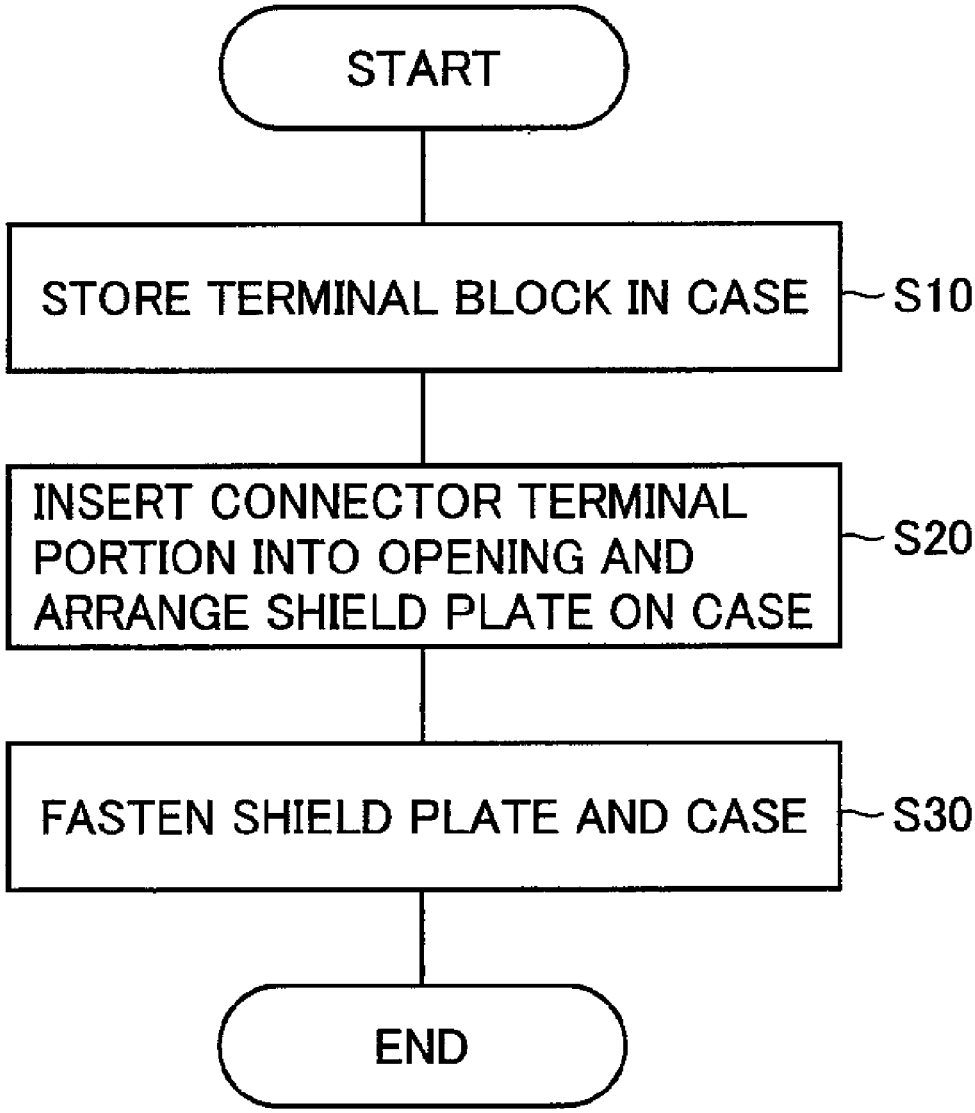
FIG. 5 is a flowchart for describing a connector connection method according to one embodiment of the present invention.

Next, referring to FIG. 5, a connector connection method according to the present embodiment will be described. Referring to FIG. 5, in step 10 (hereinafter a step is abbreviated such as "S10"), terminal block 30 is stored in case 10. Next, in S20, connector terminal portion 20 is inserted into case 10 from opening 13, and shield plate 30 is arranged on case 10 so that first portion 31 and second portion 32 are respectively positioned on side surface 11 and top surface 12 of case 10. Then, after fastening terminal block 30 and connector terminal portion 20 by bolt 60, in S30, case 10 and second portion 32 of shield plate 30 are fastened by bolt 40 inserted from above top surface 12. Thus, first portion 31 of shield plate 30 elastically deforms conforming to side surface 11 positioned around opening 13, and opening 13 is closed by first portion 31.

In general connector structures, often the fastening volt is inserted from the direction along which the connector is inserted (in the lateral direction in the present embodiment) and tightened, so as to ensure the shielding feature of the opening. However, when such a configuration is employed, if other devices are arranged at a position on the side of the case and in proximity to the case, it becomes difficult to perform the tightening work of the fastening bolt. In particular, since cable 800 for motor-generator 200 is connected to PCU 700 after engine 100 is mounted in engine room 2, often an adequate space is not ensured in engine room 2. Therefore, it is preferable that the inserting direction of the connector and that of the fastening bolt are different.

With the connector connection structure of the present embodiment, as described above, in accordance with second portion 32 of shield plate 30 being fastened to case 10 by bolt 40, first portion 31 of shield plate 30 can be deformed so as to conform to side surface 11 positioned around opening 13, thereby causing first portion 31 to tightly adhere to side surface 11 so that opening 13 is closed by first portion 31. Here, since connector terminal portion 20 and bolt 40 are inserted into case 10 from directions different from each other, even when the space is tight at the portion opposite to the connector attaching portion (i.e., the portion positioned on the side of case 10), the space for performing insertion and tightening of bolt 40 can easily be ensured. Accordingly, a connector connection structure capable of closing opening 13 of case 10 while improving the performance of storing PCU 700 can be provided.

Allowing bent angle θ2 of bent portion to be an acute angle (for example, about 89°), tight adhesion feature of shield plate 30 to side surface 11 can further be improved.

Allowing the direction of inserting bolt 40 (arrow DR40 direction) for fixing shield plate 30 to case 10 and the direction of inserting bolt 60 (arrow DR60 direction) for fixing connector terminal portion 20 to terminal block 50 to be the same, tightening of bolts 40, 60 are further facilitated.

The above description can be summarized as follows. The connector connection structure according to the present embodiment includes: case 10 having side surface 11 as a "first surface" and top surface 12 as a "second surface", respectively extending in directions crossing each other at angle θ1 as a "first angle", and opening 13 formed at side surface 11; and connector terminal portion 20 inserted into case 10 from opening 13; and terminal block 50 arranged in case 10 and connected to connector terminal portion 20. The structure further includes shield plate 30 as a "closing portion" closing opening 13, and bolt 40 as a "fastening member" inserted into case 10 from above top surface 12 and fastening case 10 and shield plate 30. Shield plate 30 has first portion 31 extending along side surface 11 and closing opening 13, second portion 32 extending along top surface 12, and bent portion 33 positioned between first portion 31 and second portion 32 and bent at angle θ2 as a "second angle" being smaller than angle θ1. Bolt 40 fastens case 10 and second portion 32 of shield plate 30.

A connector connection method according to the present embodiment includes, as shown in FIG. 5, the steps of: storing (S10) terminal block 50 in case 10 having side surface 11 and top surface 12, respectively extending in directions crossing each other at angle θ1 and opening 13 formed at side surface 11; inserting (S20) connector terminal portion 20 into case 10 from opening 13, and arranging, on case 10, shield plate 30 having first portion 31 positioned on side surface 11, second portion 32 positioned on top surface 12, and bent portion 33 positioned between first portion 31 and second portion 32 and bent at angle θ2 being smaller than angle θ1; and fastening (S30) case 10 and second portion 32 of shield plate 30 by bolt 40 inserted from above top surface 12 while deforming first portion 31 of shield plate 30 so as to conform to side surface 11 positioned around opening 13, thereby closing opening 13 by first portion 31.

It is to be noted that, in the connector connection structure and connector connection method described above, connector terminal portion 20 and terminal block 50 are fixed to each other by bolt 60 as the "additional fastening member", and bolt 60 is inserted into connector terminal portion 20 and terminal block 50 from an identical direction (arrow DR60 direction) as bolt 40.

Although the present invention has been described and illustrated in detail, it is clearly understood that the same is by way of illustration and example only and is not to be taken by way of limitation, the scope of the present invention being interpreted by the terms of the appended claims.

What is claimed is:

1. A connector connection structure, comprising:

a case having first and second surfaces extending in directions crossing each other at a first angle and an opening formed at said first surface;

a connector terminal portion inserted into said case from said opening;

a terminal block arranged in said case and connected to said connector terminal portion;

a closing portion having a first portion extending along said first surface and closing said opening, a second portion extending along said second surface, and a bent portion positioned between said first portion and said second portion and bent at a second angle being smaller than said first angle, and a fastening member inserted into said case from above said second surface and fastening said case and said second portion of said closing portion.

2. The connector connection structure according to claim 1, wherein said second angle is an acute angle.

3. The connector connection structure according to claim 1, wherein said connector terminal portion and said terminal block are fixed to each other by an additional fastening member, and said additional fastening member is inserted into said connector terminal portion and said terminal block from an identical direction as said fastening member.

4. The connector connection structure according to claim 1, wherein a control apparatus controlling a rotating electric machine for driving a vehicle is arranged in said case.

5. A vehicle comprising the connector connection structure according to claim 1.

6. A connector connection method, comprising the steps of storing a terminal block in a case having first and second surfaces extending in directions crossing each other at a first angle and an opening formed at said first surface;

inserting a connector terminal portion into said case from said opening, and arranging, on said case, a closing portion having a first portion positioned on said first surface, a second portion positioned on said second surface, and a bent portion positioned between said first portion and said second portion and bent at a second angle being smaller than said first angle; and fastening said case and said second portion of said closing portion by a fastening member inserted from above said second surface while deforming said first portion of said closing portion so as to conform to said first surface positioned around said opening, thereby closing said opening by said first portion.

* * * * *